US008251121B1

(12) United States Patent
Casey

(10) Patent No.: US 8,251,121 B1
(45) Date of Patent: Aug. 28, 2012

(54) SHADE FOR BUILDING OPENINGS

(76) Inventor: Shawn V. Casey, Fort Walton Beach, FL (US)

( * ) Notice: Subject to any disclaimer, the term of this patent is extended or adjusted under 35 U.S.C. 154(b) by 153 days.

(21) Appl. No.: 12/806,485

(22) Filed: Aug. 12, 2010

(51) Int. Cl.
*A47H 23/00* (2006.01)

(52) U.S. Cl. ..... 160/327; 160/368.1; 403/46

(58) Field of Classification Search ..... 160/368.1, 160/327, 328; 403/46, 43; 182/138, 139
See application file for complete search history.

(56) References Cited

U.S. PATENT DOCUMENTS

| | | | | |
|---|---|---|---|---|
| 1,061,060 | A * | 5/1913 | Ford | 403/46 |
| 1,321,113 | A * | 11/1919 | Johnson | 403/46 |
| 1,987,488 | A | 1/1935 | Morelli | |
| 3,480,069 | A * | 11/1969 | Handwerker | 160/354 |
| 3,807,481 | A | 4/1974 | Heider et al. | |
| 4,025,207 | A * | 5/1977 | Johnson, Jr. | 403/46 |
| 4,509,576 | A | 4/1985 | Giovanni | |
| 4,557,311 | A | 12/1985 | Reining | |
| 5,271,446 | A | 12/1993 | Hwang | |
| 5,915,449 | A | 6/1999 | Schwartz | |
| 6,176,050 | B1 | 1/2001 | Gower | |
| 6,263,949 | B1 | 7/2001 | Guthrie, Jr. | |
| 6,412,540 | B2 | 7/2002 | Hendee | |
| 6,510,658 | B1 | 1/2003 | Muller-Peddinghaus | |
| 6,513,566 | B2 | 2/2003 | Larin | |
| 6,758,306 | B2 * | 7/2004 | Walls et al. | 182/138 |
| 6,865,852 | B2 * | 3/2005 | Gower | 52/222 |
| 2004/0159345 | A1 | 8/2004 | Gower | |
| 2008/0053507 | A1 * | 3/2008 | Palumbo | 135/123 |
| 2009/0145048 | A1 | 6/2009 | Gorman et al. | |

* cited by examiner

*Primary Examiner* — Blair M. Johnson
(74) *Attorney, Agent, or Firm* — Peter Loffler

(57) ABSTRACT

A screened panel spans at least a portion of an opening of a building in order to shade occupants thereat. The panel has hems on all sides that overlap at the corners whereat grommets are located. Tensioning members attach at least two of the corners in order to provide a tight fit of the panel within the opening, the tensioning members being turnbuckles with carabiners on the distal ends thereof. Spring-locks are used to prevent rotation of the turnbuckles once the appropriate tension is achieved. Reinforcement bars within the upper and lower hems and a strong flexible webbing within the side hems provide for a strong panel periphery which adds rigidity and stability to the overall panel.

18 Claims, 8 Drawing Sheets

SHADE FOR BUILDING OPENINGS

BACKGROUND OF THE INVENTION

1. Field of the Invention

The present invention relates to a shading device that shades users from the sun and the wind, the device being installed within building openings such as balconies, decks, and verandahs.

2. Background of the Prior Art

Many people like to live in apartments and condominiums, especially as they enter their retirement years or simply as a second home. No lawns to mow, roofs to fix or many of the other major maintenance headaches that come with single family house ownership. One of the features of condominium life is the fact that many, if not most units come with a balcony allowing occupants to be able to sit on the balcony and enjoy the outdoors without the need to exit the unit. Such balconies are particularly enjoyable on waterfront condominium units.

While such balconies are nice, oftentimes the balcony occupants experience sunshine that is uncomfortable. The sun, bearing down on the occupants can be quite hot and can cause sunburn without adequate skin protection. Blowing wind can also have discomforting effects upon balcony dwellers as can rain. Such discomforts are not limited to balcony occupants but also affect people on verandahs and open air porches.

Many people attempt to counter such adverse conditions by putting up a barrier to shield the occupants. One such barrier is an umbrella. The umbrella is installed and positioned so as to block the sun from shining down on the occupants, thereby providing a shady environment. While relatively simple and effective against both sun and rain, the umbrella does little to shield occupants against wind. In fact, many umbrellas must be taken down when the wind becomes sufficiently strong or risk a failure of the umbrella mounting, a failure that can be quite dangerous, especially if the umbrella is mounted near the edge on an upper floor of a high-rise unit. Additionally, the umbrella is often insufficient in size to be able to provide shading for the entire area under enjoyment. In many situations, such as relatively deep and low ceiling balconies, the umbrella may not be effective at all, especially when attempting to shade against the sun that is low in the sky as the sun tends to be in the mornings, evenings, and winter months.

On the other extreme of shading systems are structural enclosures that are built onto the balcony, deck, or verandah. Such systems, which are not to be confused with sun rooms, tend to be more popular in the northern climates where thermal control of the open space is another consideration in the winter months, are framed structures that have translucent panes made from glass, Plexiglas, etc., held within the frames. The panes are tinted for sun shading with some of the panes being slidable to allow opening and closing of the panes. By being a solid barrier, such devices provide complete abatement against wind and rain when the panes are in a closed position. While effective, such units are very costly to install and maintain, are essentially permanent, and take away from the open air feeling that the occupants go onto the balcony for. Additionally, many condominium associations do not permit these types of structures to be installed in the building.

A middle ground shading system uses a thin flexible sheet of material, such as wicker or a mesh material, which is installed between the floor and the ceiling of the opening to be protected. Such systems, which are stored as a roll, may use several rolls for a given opening. These systems, which are relatively easy to install and remove and are not of a permanent nature, offer sun, wind, and rain shielding for substantially the entire opening, if desired. However, such systems tend to be relatively flimsy so that a relatively strong wind or even a gust can cause such systems to fail, such failures often being fatal to the device. Additionally, such systems tend to lack a sufficient adjustment system so that at best, each roll is loosely fit within its opening. This loose fit results in the wicker or mesh sagging so that when the wind acts upon the device, an unpleasant fluttering noise created by the wicker or mesh occurs.

What is needed is a shading system that can be installed within a building's opening, including on a balcony, a deck, a verandah, etc., that shades occupants from the sun, wind, and rain, and that addresses the above stated shortcomings currently found in the art. Specifically, such a shading system must be easy to install into and remove from the building opening, preferably without the need for specialized tools. Such a shading system must be able to shade as much of the area under consideration as desired even in deep balcony configurations with or without low ceilings and against most conditions including low lying sun positions. Such a shading system must not be considered a permanent structural addition to the building within which the system is being installed so as to not run afoul of any restrictive covenants that may be present or the need to obtain a building permit to install the device. Such a shading system must leave the occupants using the balcony, deck, verandah, etc., with the feeling that they are still outside of the building itself. Such a shading system must be able to withstand strong sustained winds and gusts without fear of catastrophic failure and must be adjustable so as to be tight within the opening so as to prevent the shading system from fluttering in the wind.

SUMMARY OF THE INVENTION

The shade for building openings of the present invention addresses the aforementioned needs in the art by providing a shading system for building balconies, decks, verandahs, etc., that shades occupants from the sun, wind, and rain, and is easy to install into and remove from the building opening, without the need for specialized tools. The shade for building openings is able to shade as much of the area under consideration as desired even in deep balcony configurations, with or without low ceilings, and against most conditions including low lying sun positions. The shade for building openings is not considered a permanent structural addition to the building within which the system is being installed so that it does not ten to run afoul of restrictive covenants or rules that may be present. The present invention does not tend to enclose or cocoon the building opening within which it is installed so that the occupants using the balcony, deck, verandah, etc., feel like they are outside of the building itself. The shade for building openings is designed to be able to withstand strong sustained winds as well as strong gusts without fear of catastrophic failure. A tensioning system on the present invention allows the device to be adjustable within the opening, thereby preventing shade sag which helps prevent the shade from unpleasantly fluttering in the wind. The shade for building openings is lightweight, easy to handle, easy to transport, easy to store, and easy to clean and is manufactured using standard manufacturing techniques.

The shade for building openings of the present invention is comprised of a panel member that is made from a screen or mesh material. The panel member has a top edge and an opposing bottom edge joined by a first side edge and an opposing second side edge. A first hem is formed at the top edge, a second hem is formed at the bottom edge, a third hem is formed at the first side edge, and a fourth hem is formed at the second side edge. A first, relatively rigid reinforcement bar is disposed within the first hem while a second, relatively rigid reinforcement bar is disposed within the second hem. A first heavy duty flexible webbing member is disposed within the third hem and has ends that are each attached to a respective one of the bar members while a second heavy duty, relatively flexible webbing member is disposed within the fourth hem and also has ends that are each attached to a respective one of the bar members. A first corner that has a first grommet is located at the overlap of the first hem and the third hem, the first grommet passing through the first bar member and the first webbing member, a second corner that has a second grommet is formed at the overlap of the first hem and the fourth hem, the second grommet passing through the first bar member and the second webbing member, a third corner that has a third grommet is formed at the overlap of the second hem and the third hem, the third grommet passing through the second bar member and the first webbing member and a fourth corner that has a fourth grommet is formed at the overlap of the second hem and the fourth hem, the fourth grommet passing through the second bar member and the second webbing member. A first turnbuckle that has a first rod with a first saddle clip thereon is attached to the first grommet, the first turnbuckle also has an opposing second rod that has a first carabiner thereon attached via a second saddle clip. A second turnbuckle that has a third rod with a third saddle clip thereon is attached to the second grommet, the second turnbuckle also has an opposing fourth rod that has a second carabiner thereon attached via a fourth saddle clip. A first attachment member is attached to the third grommet while a second attachment member is attached to the fourth grommet. A first spring lock has a first pin end that is received within a first opening on the first turnbuckle and an opposing first hooked end that is received by the second saddle clip. A second spring lock has a second pin end that is received within a second opening on the second turnbuckle and an opposing second hooked end that is received by the fourth saddle clip. The first saddle clip may be attached directly to the first grommet or may be attached via a third carabiner that is attached to the first saddle clip and a first panel hook connector that is attached to the third carabiner and to the first grommet and the third saddle clip may be attached directly to the second grommet or may be attached via a fourth carabiner that is attached to the third saddle clip and a second panel hook connector that is attached to the fourth carabiner and to the second grommet. The first attachment member may be a third panel hook connector while the second attachment member may be a fourth panel hook connector. Alternately, the first attachment member may be a third turnbuckle that has a fifth rod with a fifth saddle clip thereon attached to the third grommet, the third turnbuckle also has an opposing sixth rod that has a fifth carabiner thereon attached via a sixth saddle clip. The fifth saddle clip may be attached directly to the third grommet or may be attached via a sixth carabiner that is attached to the fifth saddle clip and a third panel hook connector that is attached to the sixth carabiner and to the third grommet and the second attachment member may be a fourth turnbuckle that has a seventh rod with a seventh saddle clip thereon attached to the fourth grommet, the fourth turnbuckle also has an opposing eighth rod that has a seventh carabiner thereon attached via an eighth saddle clip. The seventh saddle clip may be attached directly to the fourth grommet or may be attached via an eighth carabiner that is attached to the seventh saddle clip and a fourth panel hook connector that is attached to the eighth carabiner and to the fourth grommet. If needed, a third spring lock has a third pin end that is received within a third opening on the third turnbuckle and an opposing third hooked end that is received by the sixth saddle clip while a fourth spring lock has a fourth pin end that is received within a fourth opening on the fourth turnbuckle and an opposing fourth hooked end that is received by the eighth saddle clip.

BRIEF DESCRIPTION OF THE DRAWINGS

Similar reference numerals refer to similar parts throughout the several views of the drawings.

DESCRIPTION OF THE PREFERRED EMBODIMENT

Figure 1:
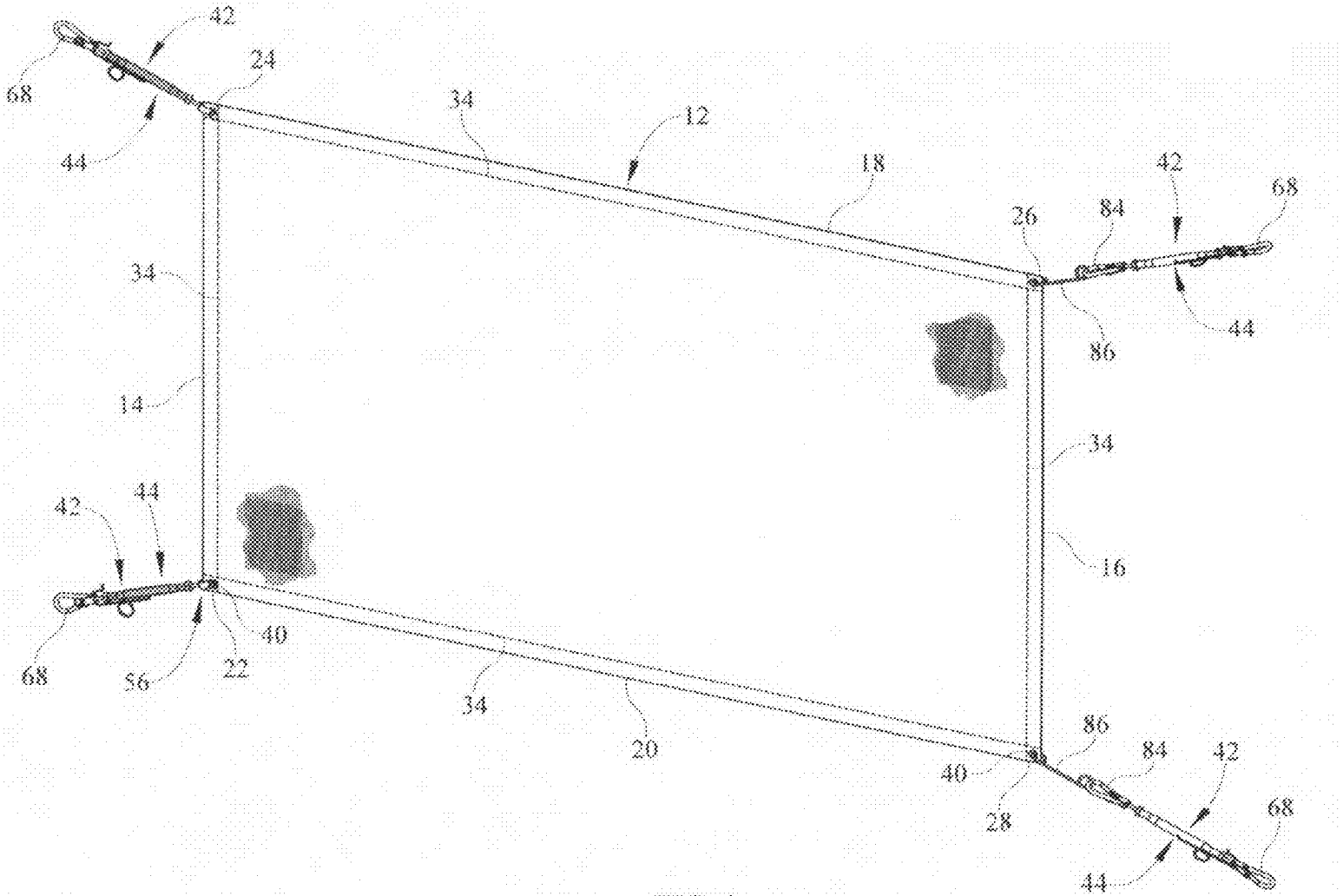
FIG. 1 is a perspective view of the shade for building openings of the present invention.

Referring now to the drawings, it is seen that the shade for building openings of the present invention, generally denoted by reference numeral 10, is comprised of a main panel 12 that has a top edge 14, a bottom edge 16, a first side 18, and a second side 20, so as to have a first corner 22, a second corner 24, a third corner 26, and a fourth corner 28. The main panel 12 is made from a screen or mesh material (cloth, vinyl, nylon, etc., and ideally of such a construction so as to be easily washed, and ideally having appropriate coatings and/or additives within the material to help prevent panel 12 degradation from long-term exposure to the elements, especially the sun), the fineness of the actual screen being dependent on how much sun blocking is desired, the finer the screen, the more sun blocking (the size of the screen dictates how much wind can pass through the main panel 12, although even a very fine screen main panel 12 will allow sufficient air to circulate past the main panel 12 so as to provided a relatively comfortable environment for occupants of the balcony—most rain will be blocked by the main panel 12 irrespective of the grade of the screen used, so that if the screen allows rain to pass therethrough, the weather conditions are such that the occupants probably do not want to be on a balcony B, verandah, deck, etc., anyway) is achieved. The panel 12 is formed by taking the screen material and hemming each of the two edges 14 and 16 and sewing the hems 30 into place. Similarly, the two sides 18 and 20 are also hemmed and each of the hems 32 is sewn into place (the order of hemming, either edges 14 and 16 first or sides 18 and 20, is not material). The hemming of the both the edges 14 and 16 and both the sides 18 and 20 results in the hems 30 and 32 respectively overlapping in each of the corners 22, 24, 26, and 28 resulting in the corners being particularly strong. The sew lines 34 used to create the hems 30 and 32 are made using a heavy duty thread, which may be nylon or other material, and can be double or even triple sew lines 34 as desired. In the pocket formed within the hems 30 at the top edge 14 and at the bottom edge 16 a reinforcement member 36 is inserted and held therein. The reinforcement member 36, which is a relatively flat bar member and made from an appropriate material such as fiberglass, plastic, metal, etc., provides rigidity to the top edge 14 and the bottom edge 16. A heavy webbing member 38, which webbing member is typically made from nylon, polyester, or polypropylene, is installed within the pockets formed in the hems 32 of the two sides 18 and 20, which helps reinforce the sides of the panel 12 while allowing the panel 12 to remain flexible along its vertical axis. A grommet 40 is installed in each of the corners 22, 24, 26 and 28 in the usual way with the double hemming thereat providing a particularly strong attachment of grommet 40 to corner 22, 24, 26 and 28, with the grommet 40 passing through the reinforcement member 36 as well as the webbing 38 which provides an incredibly strong and integrated overall panel with a very strong outer periphery. In order to pass the grommet 40 through the double hems 30 and 32 of the main panel 12, the reinforcement member 36 and the webbing 38, a sufficiently strong grommet press (not illustrated) must be used. I have found that a press that exerts approximately 1,200 pounds of pressing force works satisfactorily, although a different level of force may be needed, depending on the particular grade of panel 12, reinforcement member 36 and webbing 38 used.

Attached to each of the grommets 40 is an attachment member 42. The central member of the attachment member 42 is turnbuckle 44. As seen, the turnbuckle 44 has a main body member 46 with a rod 48 threadably disposed within each end of the body member 46, each rod 48 having a nub 50 on its end, and each rod 46 being rotatably adjustable by an adjustment nut 52. An opening 54 is located within the body member 44.

As seen, attached to each rod 48 of the turnbuckle 44 is a saddle clip 56. As seen, the saddle clip 56 has a generally U-shaped body 58 with an opening 60 located at the body's bottom and a cylindrical connector 62 bridging the top, the connector 62 being removable in the usual way by passing the connector 62 through the aligned openings 64 at the top of the body 58 with the illustrated ring 66 preventing one end of the connector 62 from being discharged from the openings 64 and an appropriate holder (cotter, spring-loaded ball, etc., (none illustrated) on the opposing end preventing the connector 62 from being discharged from the openings 64. The rod 48 of the turnbuckle 44 is connected to the saddle clip 56 by aligning the nub 50 of the rod 48 with the opening 60 of the saddle clip 56 and passing the nub 50 therethrough. Rotation of the nub 50 ninety degrees prevents the nub 50 from being removed from the saddle clip 56 and the saddle clip 56 is now attached to the turnbuckle 44. Attached to one of the saddle clips 56 is a carabiner 68. A spring lock 70 is provided, such that the spring lock 70 has a main body 72 with at least one coil 74 therealong, a first pinned end 76 and a second pinned end 78, the second pinned end 78 also having a hook 80 thereat. The spring lock 70 is positioned so that the first pinned end 76 is received within the opening 54 on the main body 46 of the turnbuckle 44 and passing the second end 78 through the saddle clip 56 so that the hook 80 sits on the bottom of the saddle clip 56. The specific attachment architecture connected to the other saddle clip 54 is dependent on how much distance exists between the bottom edge 16 of the main panel 12 and the attachment eye bolts 82 or other attachment points at the bottom of the balcony B of the building whereat the device 10 is installed.

Figure 2:
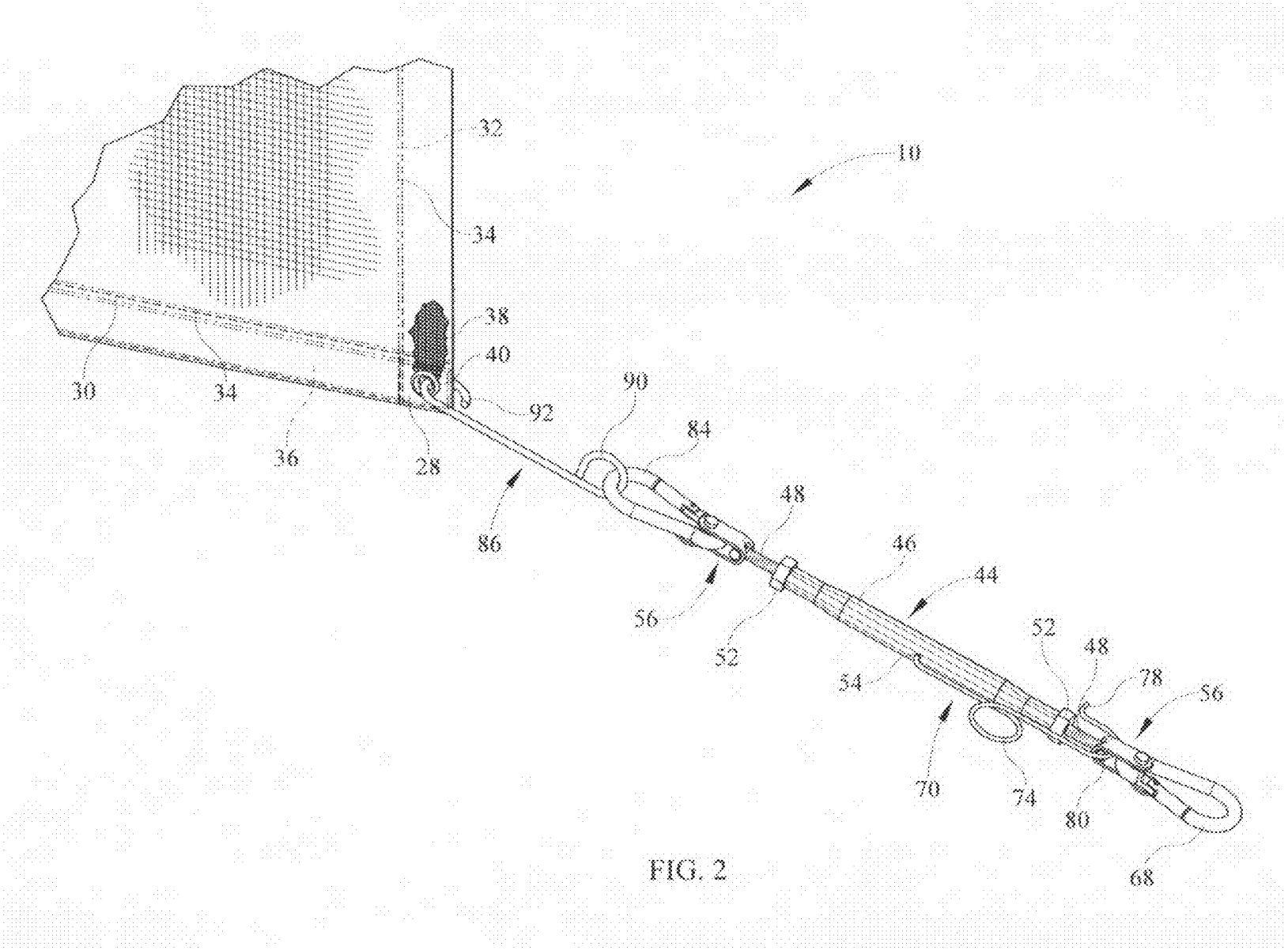
FIG. 2 is a close-up perspective view of one of the lower corners of the shade for building openings.

FIG. 2 illustrates a simplified attachment of the bottom corners 26 and 28 to the eye bolts 82 wherein the main panel 12 is relatively long. As seen, in this configuration, the second saddle clip 56 is attached directly to the grommet 40 at these corners 26 and 28 via the connector 62 on the saddle clip 56.

Figure 3:
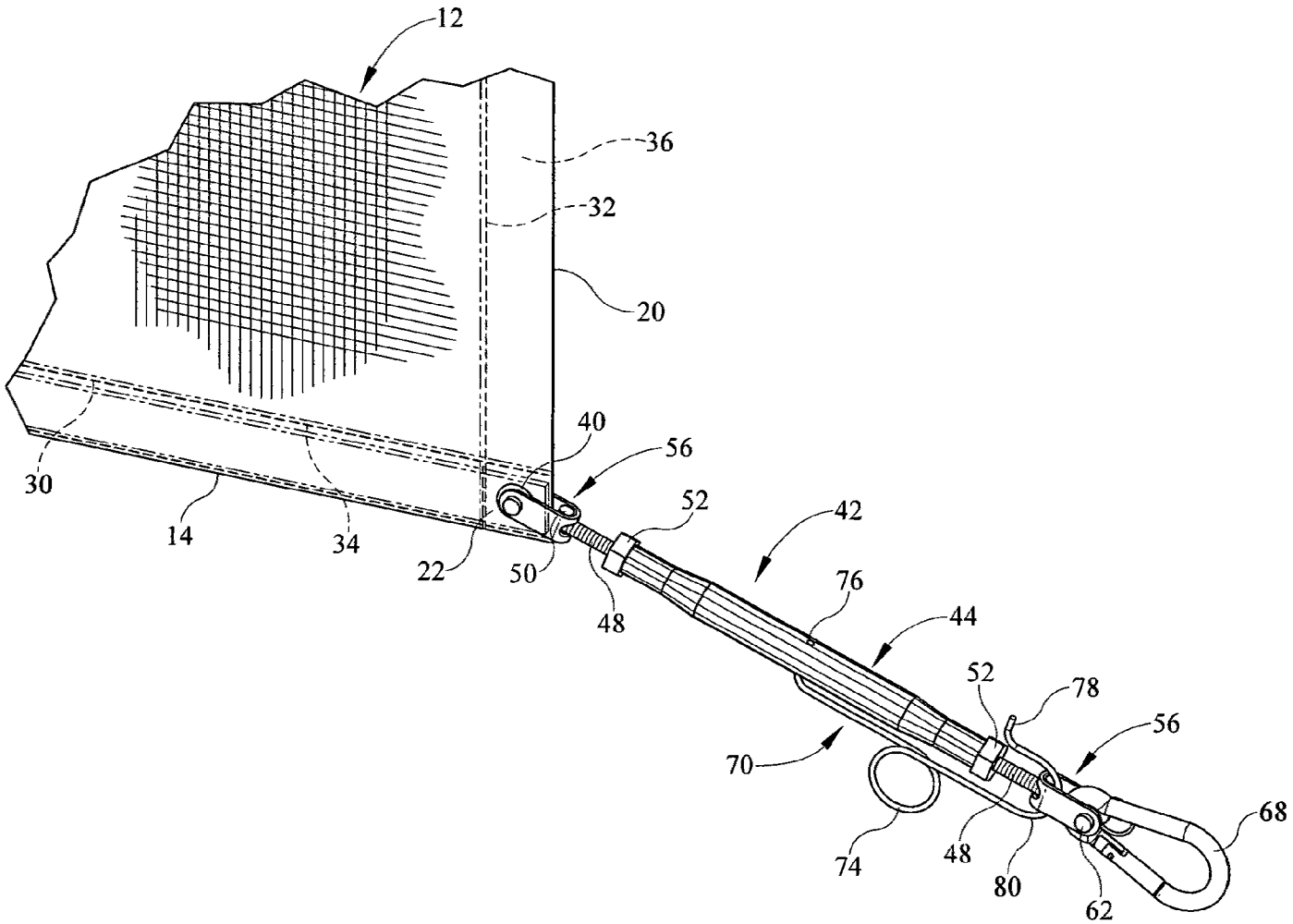
FIG. 3 is a close-up perspective view of one of the upper corners of the shade for building openings.
Figure 4:
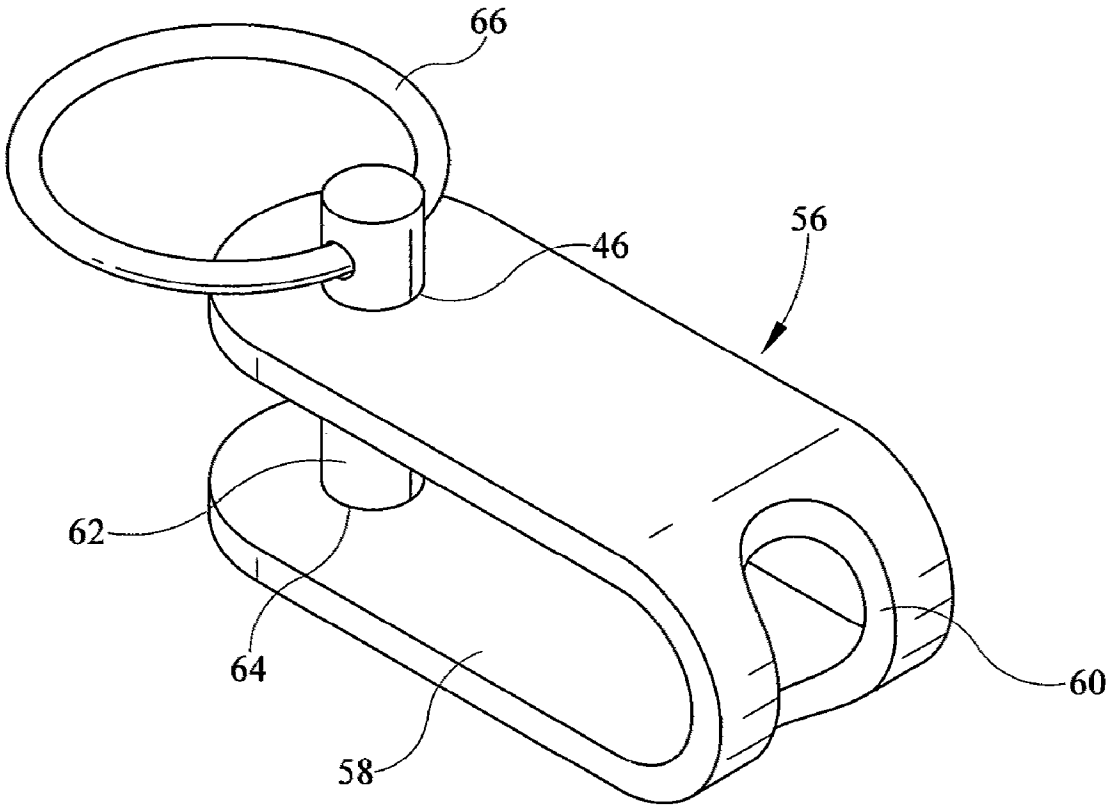
FIG. 4 is a perspective view of the saddle clip used with the shade for building openings.
Figure 5:
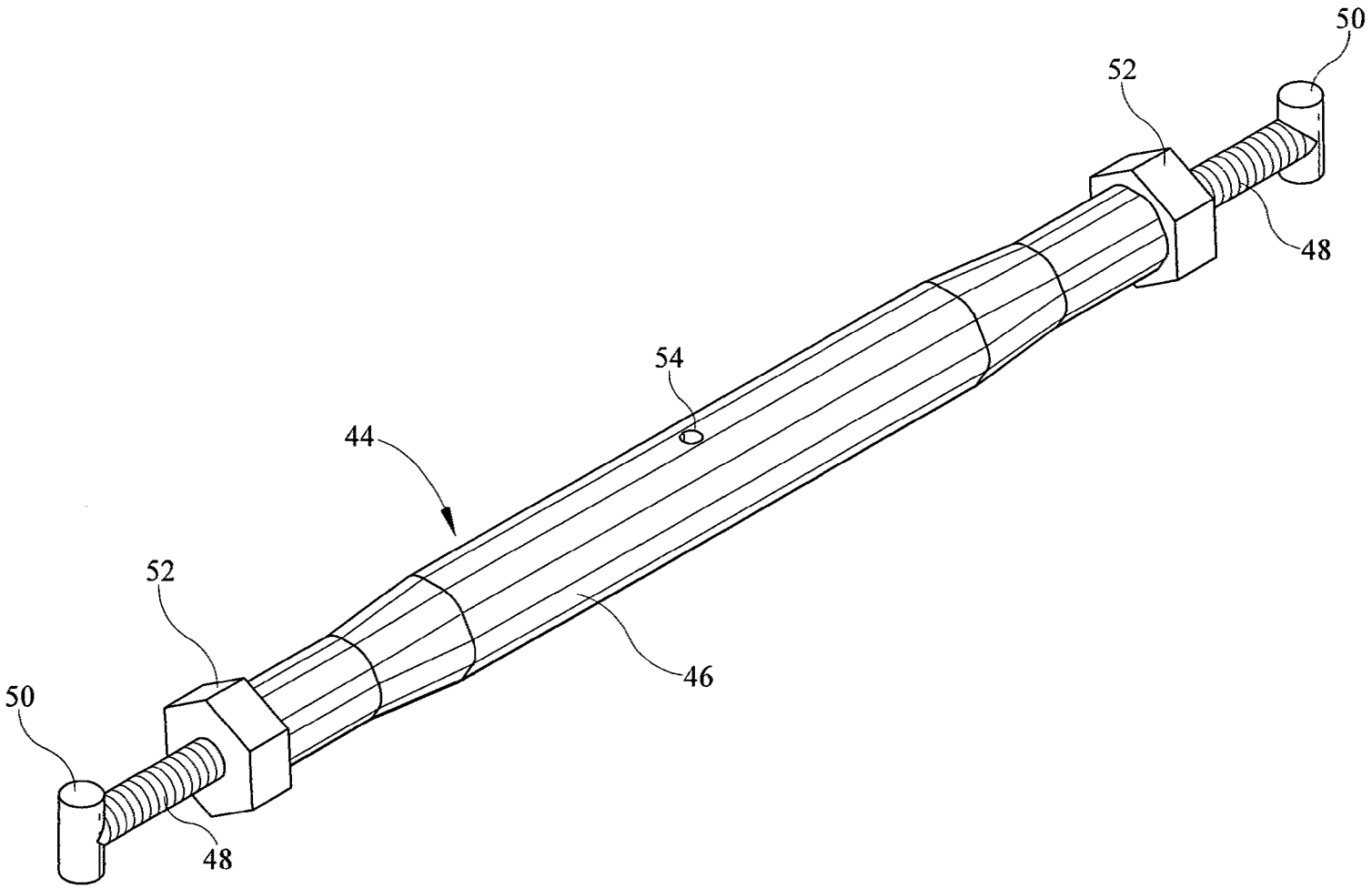
FIG. 5 is a perspective view of the tensioning rod used with the shade for building openings.
Figure 6:
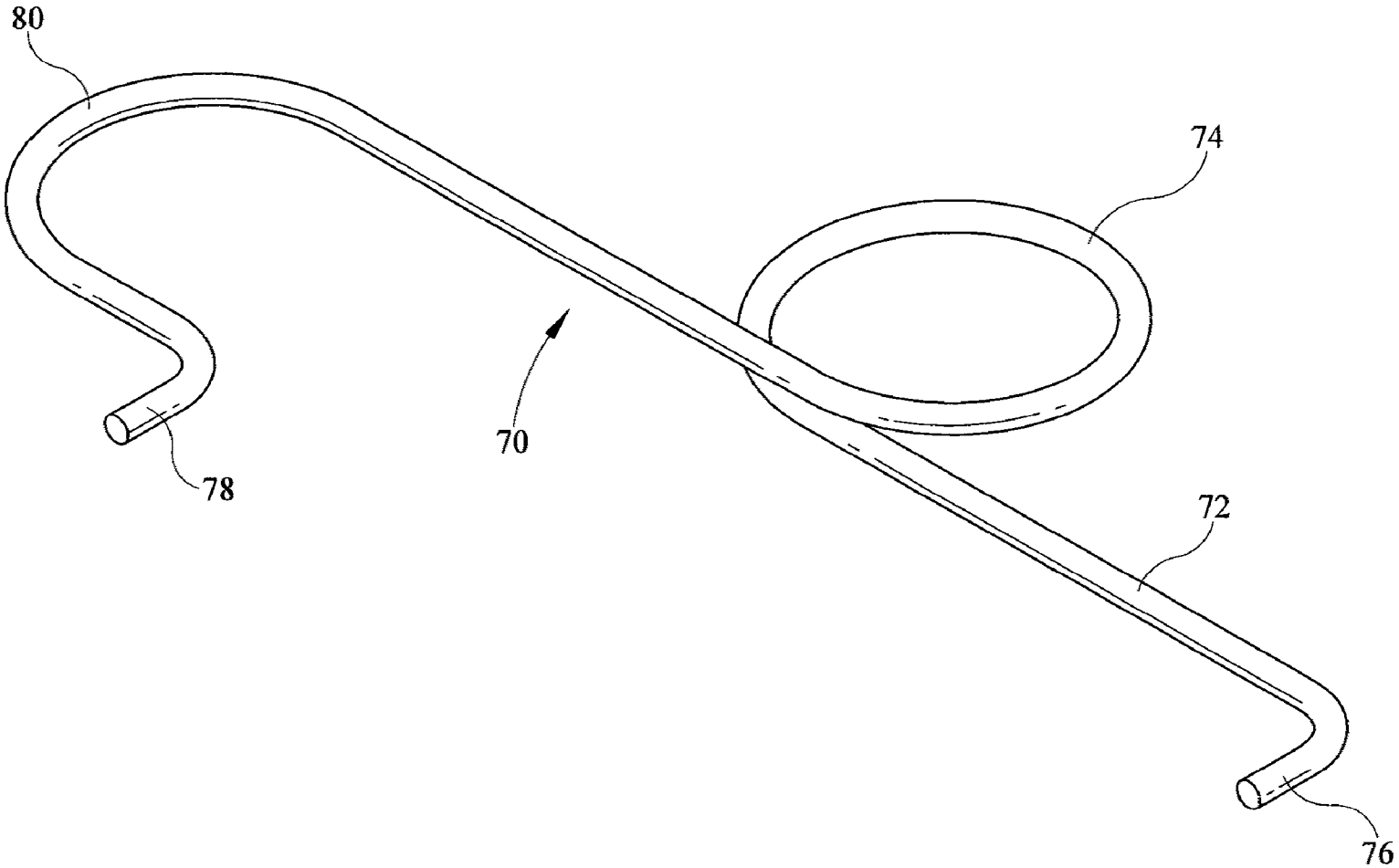
FIG. 6 is a perspective view of the spring lock used with the shade for building openings.
Figure 7:
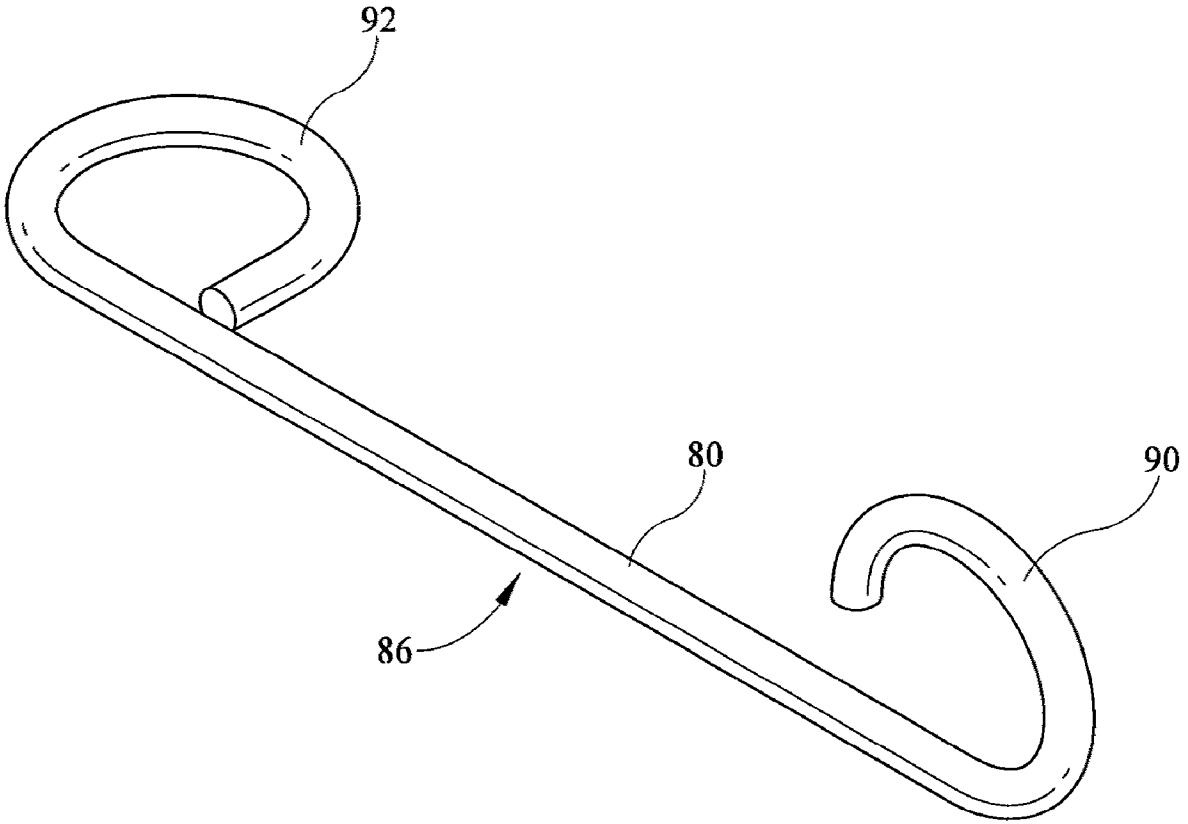
FIG. 7 is a perspective view of the screen hook connector used with the shade for building openings.
Figure 8:
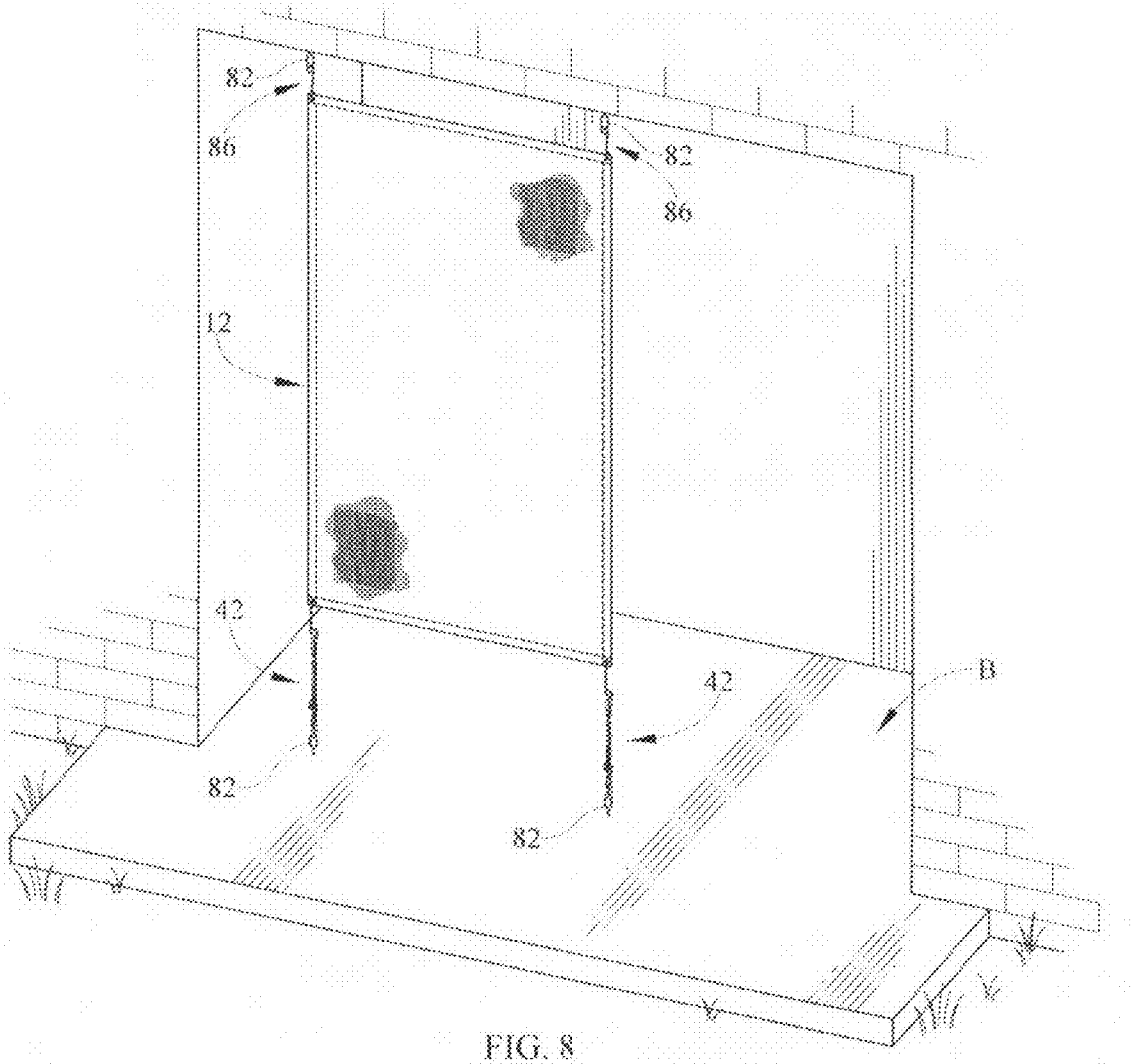
FIG. 8 is an environmental view of the shade for building openings installed within a building using the panel hook connector for the upper attachment points.

FIG. 3 illustrates the expanded attachment of the bottom corners 26 and 28 to their respective eye bolts 82 wherein the main panel 12 is relatively shorter along its vertical. In this configuration, a second carabiner 84 is connected is to the saddle clip 56 on the opposing side of the turnbuckle 44. A panel hook connector 86, which has a main body 88 with a first hook 90 on one end and a second hook 92 on the opposing end, the second hook 92 being radially offset ninety degrees from the first hook 90 with respect to the longitudinal axis of the main body 88, is provided, such that the first hook 90 is received within the second carabiner 84 while the second hook 92 is received within the grommet 40 at the corners 26 and 28.

The various components of the attachment members 42, as well as the grommets 40, and eye bolts 82, are each made from an appropriate non-corrosive material, such as aluminum, stainless steel, plastic, or have an appropriate non-corrosion coating thereon, in order to protect the components in the damp environment whereat the present invention 10 may be disposed.

The upper corners 22 and 24 may be attached to their respective eye bolts 82 at the top of the balcony B in similar fashion to the attachment of the lower corners 26 and 28 and can be mixed and matched so that, for example, all four corners 22, 24, 26 and 28 have the attachment member 42 as illustrated in FIG. 2 (or FIG. 3) or the upper corners 22 and 24 (or the lower corners 26 and 28) have the attachment member 42 of FIG. 2 and the opposing corners have the attachment member 42 of FIG. 3. However, as tension adjustment needs to be made only on one edge (typically the bottom edge 16 is easier in most installations), the upper corners 22 and 24 can be attached to their respective eye bolts 82 via the panel hook connectors 86 such that the first hook 90 is attached to its respective eye bolt 82 and the second hook 92 is attached to its respective grommet 40—of course the attachment configuration can be flipped so that the attachment members 42, either one, can be located at the top of the balcony B and the panel hook connectors 86 at the bottom of the balcony B In order to use the shade for building openings 10 of the present invention, the main panel 12 is installed within the building opening B by providing attachment points 82 on or near the floor and on or near the ceiling (neither illustrated) of the building opening and anchoring these points 82 in appropriate fashion—existing attachment points, if appropriate, can also be used. The attachment members 42 of either FIG. 2 or FIG. 3 are attached to the lower corners 26 and 28 (or upper corners 22 and 24) and to their respective attachment points 82 on the balcony B while either the attachment members 42 of FIG. 2 or FIG. 3 or the panel hook connectors 86 are attached to the opposing corners and to their respective attachment points 82. Each turnbuckle 44 is length adjusted, via the adjustment nuts 52 (either via hand or an appropriately sized wrench) in order to make the main panel 12 appropriately tensioned and thus fairly taut within the building opening B. The spring locks 70 are installed onto each turnbuckle 44 as described earlier. The device 10 is now ready for use and will block sun, wind and rain as the conditions dictate. The attachment members 42 assure a very strong and secure fit with the use of the saddle clip 56 and carabiner 68 combination on the distal ends of each attachment member 42 allow sufficient movement in both the X-direction and the Y-direction (these terms being for convenience only). I have found that through extended use in certain conditions, over time the turnbuckles 44 tend to rotate and thus loosen the overall system. Accordingly, the spring locks 70 at each turnbuckle 44 allow for a certain amount of rotation of the turnbuckle 44 in wind conditions, with the spring nature of the spring lock 70 returning the turnbuckle 44 to its original desired position without affecting the length of the turnbuckle 44. This allows for continuous tensioning of the main panel 12 while offering dynamic stability.

The reinforcements members 36 and webbing 38 within the hems 30 and 32 respectively give the overall main panel 12 additional strength and rigidity even in very adverse winds so that the device 10 can remain in place even in the face of a storm which may be very strong. In a particularly strong storm, such as a tropical cyclone, it is best to remove the device 10 which is accomplished quickly and easily by unclipping the carabiners 68 from their respective attachment points, loosening one or more of the turnbuckles 44 slightly if needed as well as the panel hook connectors 86 if used. The device can then be rolled up into a fairly small configuration and stored as desired. There is no need to remove the attachment members 42 from the device 10 for storage, although the attachment members 42 can be removed if desired.

While the device has been shown as being essentially rectangular in shape, other shapes are possible such as triangular, pentagonal, hexagonal, etc., with placement of reinforcement members 34 and webbing 36, as well as grommets dependant on the particular shape and size of the panel member.

While the invention has been particularly shown and described with reference to an embodiment thereof, it will be appreciated by those skilled in the art that various changes in form and detail may be made without departing from the spirit and scope of the invention.

I claim:

1. A shade comprising:

a panel member made from a screen material, the panel member having a top edge and an opposing bottom edge joined by a first side edge and an opposing second side edge, with a first hem formed at the top edge, a second hem formed at the bottom edge, a third hem formed at the first side edge, and a fourth hem formed at the second side edge such that a first corner is located at the overlap of the first hem and the third hem, a second corner is formed at the overlap of the first hem and the fourth hem, a third corner is formed at the overlap of the second hem and the third hem, and a fourth corner is formed at the overlap of the second hem and the fourth hem;

a first turnbuckle having a first rod with a first saddle clip thereon attached to the first corner and having an opposing second rod that has a first carabiner attached thereto via a second saddle clip;

a second turnbuckle having a third rod with a third saddle clip thereon attached to the second corner and having an opposing fourth rod that has a second carabiner thereto via a fourth saddle clip;

a first spring lock having a first pin end that is received within a first opening on the first turnbuckle and an opposing first booked end that is received by the second saddle clip;

a second sprang lock having a second pin end that is received within a second opening on the second turnbuckle and an opposing second hooked end that is received by the fourth saddle clip;

a first attachment member attached to the third corner; and a second attachment member attached to the fourth corner.

2. The shade as in claim 1 further comprising a pair of relatively flat bar members, each bar member disposed within a respective one of the first hem and the second hem.

3. The shade as in claim 2 further comprising a pair of flexible webbing members, each webbing member disposed within a respective one of the third hem and the fourth hem and each attached to each of the pair of bar members.

4. The shade as in claim 1 wherein the first saddle clip is attached to the first corner via a third carabiner that is attached to the first saddle clip and a first panel hook connector that is attached to the first corner and to the third carabiner and the third saddle clip is attached to the second corner via a fourth carabiner that is attached to the third saddle clip and a second panel hook connector that is attached to the second corner and to the fourth carabiner.

5. The shade as in claim 4 wherein the first attachment member comprises a third panel hook connector and the second attachment member comprises a fourth panel hook connector.

6. The shade as in claim 4 wherein the first attachment member comprises a third turnbuckle having a fifth rod with a fifth saddle clip thereon attached to the third corner and having an opposing sixth rod that has a fifth carabiner attached thereto via a sixth saddle clip and the second attachment member comprises a fourth turnbuckle having a seventh rod with a seventh saddle clip thereon attached to the fourth corner and having an opposing eight rod that has a sixth carabiner attached thereto via an eighth saddle clip.

7. The shade as in claim 5 wherein the first attachment member is selected from the group consisting of a third panel hook connector and a third turnbuckle having a fifth rod with a fifth saddle clip thereon attached to the third corner and having an opposing sixth rod that has a fifth carabiner attached thereto via a sixth saddle clip and the second attachment member is selected from the group consisting of a fourth panel hook connector and a fourth turnbuckle having a seventh rod with a seventh saddle clip thereon attached to the fourth corner and having an opposing eight rod that has a sixth carabiner attached thereto via an eighth saddle clip.

8. The shade as in claim 7 further comprising a pair of relatively flat bar members, each bar member disposed within a respective one of the first hem and the second hem.

9. The shade as in claim 8 further comprising a pair of flexible webbing members, each webbing member disposed within a respective one of the third hem and the fourth hem and each attached to each of the pair of bar members.

10. The shade as in claim 6 further comprising:

a third spring lock having a third pin end that is received within a third opening on the third turnbuckle and an opposing third hooked end that is received by the sixth saddle clip; and a fourth spring lock having a fourth pin end that is received within a fourth opening on the fourth turnbuckle and an opposing fourth hooked end that is received by the eighth saddle clip.

11. The shade as in claim 7 further comprising:

a third spring lock having a third pin end that is received within a third opening on the third turnbuckle and an opposing third hooked end that is received by the sixth saddle clip; and a fourth spring lock having a fourth pin end that is received within a fourth opening on the fourth turnbuckle and an opposing fourth hooked end that is received by the eighth saddle clip.

12. A shade comprising:

a panel member made from a screen material, the panel member having a top edge and an opposing bottom edge joined by a first side edge and an opposing second side edge, with a first hem formed at the top edge and having a first relatively flat bar member disposed therein, a second hem formed at the bottom edge and having a second relatively flat bar member disposed therein, a third hem formed at the first side edge having a first flexible webbing member disposed therein that is attached to the first bar member and the second bar member, and a fourth hem formed at the second side edge having a second flexible webbing member disposed therein that is attached to the first bar member and the second bar member such that a first corner having a first grommet is located at the overlap of the first hem and the third hem the first grommet passing through the first bar member and the first webbing member, a second corner having a second grommet is formed at the overlap of the first hem and the fourth hem the second grommet passing through the first bar member and the second webbing member, a third corner having a third grommet is formed at the overlap of the second hem and the third hem the third grommet passing through the second bar member and the first webbing member, and a fourth corner having a fourth grommet is formed at the overlap of the second hem and the fourth hem the fourth grommet passing through the second bar member and the second webbing member;

a first turnbuckle having a first rod with a first saddle clip thereon attached to the first corner and having an opposing second rod that has a first carabiner attached thereto via a second saddle clip;

a second turnbuckle having a third rod with a third saddle clip thereon attached to the second corner and having an opposing fourth rod that has a second carabiner thereto via a fourth saddle clip;

a first spring lock having a first pin end that is received within a first opening on the first turnbuckle and an opposing first hooked end that is received by the second saddle clip; and a second spring lock having a second pin end that is received within a second opening on the second turnbuckle and an opposing second hooked end that is received by the fourth saddle clip;

a first attachment member attached to the third corner; and a second attachment member attached to the fourth corner.

13. The shade as in claim 12 wherein the first saddle clip is attached to the first corner via a third carabiner that is attached to the first saddle clip and a first panel hook connector that is attached to the first corner and to the third carabiner and the third saddle clip is attached to the second corner via a fourth carabiner that is attached to the third saddle clip and a second panel hook connector that is attached to the second corner and to the fourth carabiner.

14. The shade as in claim 13 wherein the first attachment member comprises a third panel hook connector and the second attachment member comprises a fourth panel hook connector.

15. The shade as in claim 13 wherein the first attachment member comprises a third turnbuckle having a fifth rod with a fifth saddle clip thereon attached to the third corner and having an opposing sixth rod that has a fifth carabiner attached thereto via a sixth saddle clip and the second attachment member comprises a fourth turnbuckle having a seventh rod with a seventh saddle clip thereon attached to the fourth corner and having an opposing eight rod that has a sixth carabiner attached thereto via an eighth saddle clip.

16. The shade as in claim 13 wherein the first attachment member is selected from the group consisting of a third panel hook connector and a third turnbuckle having a fifth rod with a fifth saddle clip thereon attached to the third corner and having an opposing sixth rod that has a fifth carabiner attached thereto via a sixth saddle clip and the second attachment member is selected from the group consisting of a fourth panel hook connector and a fourth turnbuckle having a seventh rod with a seventh saddle clip thereon attached to the fourth corner and having an opposing eight rod that has a sixth carabiner attached thereto via an eighth saddle clip.

17. The shade as in claim 15 further comprising:

a third spring lock having a third pin end that is received within a third opening on the third turnbuckle and an opposing third hooked end that is received by the sixth saddle clip; and a fourth spring lock having a fourth pin end that is received within a fourth opening on the fourth turnbuckle and an opposing fourth hooked end that is received by the eighth saddle clip.

18. The shade as in claim 16 further comprising:

a third spring lock having a third pin end that is received within a third opening on the third turnbuckle and an opposing third hooked end that is received by the sixth saddle clip; and a fourth spring lock having a fourth pin end that is received within a fourth opening on the fourth turnbuckle and an opposing fourth hooked end that is received by the eighth saddle clip.

* * * * *